United States Patent [19]

Barbetta et al.

[11] Patent Number: 4,752,550

[45] Date of Patent: Jun. 21, 1988

[54] TONER COMPOSITIONS WITH INNER SALT CHARGE ENHANCING ADDITIVES

[75] Inventors: Angelo J. Barbetta, Penfield, N.Y.; Doretta Agostine, Jenkintown, Pa.; Thomas R. Hoffend, Webster; Richard D. Manca, Fairport, both of N.Y.; Emery G. Tokoli, Rochester, N.Y.

[73] Assignee: Xerox Corporation, Stamford, Conn.

[21] Appl. No.: 938,304

[22] Filed: Dec. 5, 1986

[51] Int. Cl.[4] ..... G03G 9/08

[52] U.S. Cl. ..... 430/106.6; 430/110; 430/137

[58] Field of Search ..... 430/110, 137, 106.6

[56] References Cited

U.S. PATENT DOCUMENTS 4,537,848 8/1985 Yourd et al. ..... 430/110

4,621,039 11/1986 Ciccarelli et al. ..... 430/106

*Primary Examiner*—John L. Goodrow

*Attorney, Agent, or Firm*—E. O. Palazzo

[57] ABSTRACT

Toner compositions comprised of resin particles, pigment particles, and as a charge enhancing additive inner salts wherein the negative charge center is covalently attached to the positive charge center. Also disclosed are developer compositions comprised of the aforementioned toner components and carrier particles, which compositions are particularly useful for the development of the electrostatic latent images. Additionally, there can be selected for the toner and developer compositions mixtures of charge enhancing additives including mixtures of the aforementioned inner salts and second charge enhancing additives such as quaternary ammonium compounds.

66 Claims, No Drawings

TONER COMPOSITIONS WITH INNER SALT CHARGE ENHANCING ADDITIVES

BACKGROUND OF THE INVENTION

This invention is generally directed to toner compositions, and more specifically, the present invention is direct to developer and toner compositions, including magnetic toner compositons with inner salt charge enhancing additives, which additives impart a positive charge to the toner resin particles. Developer compositions containing the inner salt charge enhancing additives of the present invention are useful for enabling the development of electrostatic latent images including color images. More specifically, positively charged toner compositions comprised of the inner salt additives are particularly useful in electrostatographic imaging processes having incorporated therein a Viton coated fuser roll primarily since the inner salts do not react substantially with Viton causing undesirable decomposition thereof which adversely effects image quality. Also, the toner compositions of the present invention possess a high positive charge to mass ratio and narrow charge distributions.

Developer compositions with charge enhancing additives, especially additives which impart a positive charge to the toner resin, are well known. Thus, for example, there is described in U.S. Pat. No. 3,893,935 the use of certain quanternary ammonium salts as charge control agents for electrostatic toner compositions. In accordance with the disclosure of this patent, certain quaternary ammonium salts when incorporated into a toner material provided a composition which exhibited relatively high uniform stable net toner charge when mixed with a suitable carrier vehicle. There is also described in U.S. Pat. Nos. 2,986,521 reversible developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which it totally incorporated herein by reference, developer and toner compositions having incorporated therein as charge enhancing additives organic sulfate and sulfonate compositions. Other patents disclosing toner compositions with charge control additives include U.S. Pat. Nos. 3,944,493; 4,007,293; 4,079,014; 4,396,697; 4,291,112; 4,415,646; and 4,394,430. Moreover, there is disclosed in U.S. Pat. No. 4,560,635, the disclosure of which is totally incorporated herein by reference, Viton compatible toner compositions containing therein as charge enhancing additives distearyl dimethyl ammonium methyl sulfate.

Further, there is illustrated in U.S. Pat. No. 4,298,672, the disclosure of which is totally incorporated herein by reference; positively charged toner compositions containing resin particles and pigment particles, and as a charge enhancing additive alkyl pyridinium compounds and their hydrates of the formula as recited in column 3, beginning at line 14. Examples of alkyl pyridinium compounds disclosed included cetyl pyridinium chloride. While the developer compositions disclosed in the '672 patent are sufficient for their intended purposes, it appears that they react with the polymer contained on Viton fuser rolls causing decomposition thereof. Also, several of the other charge control agents disclosed in the prior art interact with certain fuser rolls, such as Viton fuser rolls used in electrostatographic systems. This interaction causes the fuser to be adversely effected resulting in deterioration of the image quality. For example, Viton fuser rolls discolor and turn black, develop multiple surface cracks and harden when certain charge control additive compounds are contained in the toner mixture.

One Viton fuser roll selected for use in electrostatographic copying machines is comprised of a soft roll fabricated from lead oxide, and duPont Viton E-430 resin, a vinyldene fluoride hexafluoropropylene copolymer. This roll contains approximately 15 parts of lead oxide, and 100 parts of Viton E-430, which mixture is blended and cured on the roll substrate at elevated temperatures. Apparently, the function of the lead oxide is to generate unsaturation by dehydrofluorination for crosslinking, and to provide release mechanisms for the toner composition. Excellent image quality has been obtained with Viton fuser rolls, however, in some instances there results a toner fuser compatibility problem when charge control agents are part of the toner mixture. For example, it appears that certain specific charge control additives, such as quaternary ammonium compounds and alkyl pyridinium compounds, including cetyl pyridinium chloride, react with the Viton of the Viton fuser roll. For example, cetyl pyridinium chloride when part of the toner mixture appears to be catalytically decomposed by the lead oxide contained in the fuser roll, resulting in a highly unsaturated compound, which polymerizes and condenses with the unsaturated Viton E-430 material. In view of this, the Viton fuser roll turns black, develops multiple surface cracks, and the surface thereof hardens thereby resulting in image quality deterioration.

Toner compositions comprised of many of the above described charge enhancing additives are useful for permitting the development of images formed on layered photoresponsive imaging devices comprised of generating layers and transport layers. These devices usually are charged negatively rather than positively as is the usual situation with selenium photoreceptors thereby requiring a toner composition that is positively charged in order that the toner particles may be suitably attracted to the electrostatic latent image contained on the photoreceptor surface. In view of this, extensive efforts have been devoted to obtaining developer compositions containing toner resins which are positively charged. Thus, while many charge control additives are known, there continues to be a need for new additives. Specifically, there continues to be a need for additives which will not substantially adversely interact with Vitonn type fuser rolls. Additionally, there continues to be a need for charge control additives which are thermally stable at high temperatures. Moreover, there continues to be a need for positively charged toner and developer compositions with acceptable humidity insensitivity since it is known that moisture contained in the atmosphere, or moisture from other sources can adversely effect the electrical properties of the toner compositions involved.

Also, there continues to be a need for new charge enhancing additives, particularly those additives where the negative charge center is covalently attached to the positive charge center, unlike the charge additives of the prior art with a cationic and anionic moiety. Additionally, there is a need for additives which in addition to being thermally stable are substantially nontoxic. Further, there is a need for toner compositions which contain positively charged resin particles, and wherein the resulting toner compositions have desirable toner admix charging characteristics. Also, there is a need for toner compositions with a high positive charge to mass ratio, and narrow charge distribution. Moreover, there is a need for toner compositions with charge enhancing additives wherein there is substantially no adverse impact on the minimum fusing temperature of the aforementioned composition, and further wherein the triboelectric charging properties of the resulting toner compositions are relatively stable for substantial time periods.

SUMMARY OF THE INVENTION

It is an object of the present invention to provide toner and developer compositions with inner salt charge enhancing additives.

In another object of the present invention there are provided positively charged toner compositions which are useful for the development of electrostatic latent images including color images.

In yet another object of the present invention there are provided positively charged toner compositions containing as charge enhancing additives inner salt compounds.

A further object of the present invention is to provide charge enhancing additives which are thermally stable at high temperatures.

Another object of the present invention resides in the provision of inner salt charge enhancing additives which do not interact with and/or attack Viton rubber selected for use in imagining systems with certain fusing roll systems.

In another object of the present invention there is provided a developer composition with positively charged toner particles, carrier particles and inner salt charge enhancing additives.

In yet a further object of the present invention there are provided positively charged toner compositions which have desirable admix properties, and which compositions do not adversely effect minimum fusing temperatures.

Additionally, in a further object of the present invention there are provided magnetic toner compositions, and colored toner compositions containing positively charged toner particles, carrier particles, and inner charge enhancing additives.

In still a further object of the present invention there are provided positively charged toner compositions with improved admix charging characteristics, stable triboelectric charging values and wherein these compositions are substantially compatible with Viton fuser rolls.

Moreover, in another object of the present invention there are provided toner compositions containing mixtures of inner salt charge enhancing additives and other known charge enhancing additives.

These and other objects of the present invention are accomplished by providing toner compositions comprised of resin particles, pigment particles, and inner salt charge enhancing additives. More specifically, there are provided in accordance with the present invention positively charged toner compositions comprised of resin particles, pigment particles, and inner salt charge enhancing additives selected from the group consisting of phosphonium compounds, sulfopropyl derivatives, betaines, and the other components disclosed hereinafter. In addition, there are provided in accordance with the present invention positively charged toner compositions containing therein in addition to resin particles and pigment particles inner salt charge enhancing additives and other charge enhancing aditives including those as illustrated, for example, in U.S. Pat. No. 4,560,635, such as distearyl dimethyl ammonium methyl sulfate, organic sulfate and sulfonate compositions, inclusive of stearyl phenethyl dimethyl ammonium tosylates, reference U.S. Pat. No. 4,338,390; alkyl pyridinium chlorides, including cetyl pyridinium chloride, reference U.S. Pat. No. 4,298,672; and the like. Disclosures of each of the aforementioned patents are totally incorporated herein by reference.

Illustrative examples of sulfopropyl derivatives that are useful as charge enhancing additives include those of the following formula:

I.

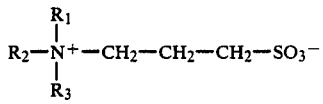

wherein $R_1$, $R_2$, and $R_3$ are independently selected from the group consisting of alkyl, aryl, substituted alkyl, and substituted aryl.

Betaines and phosphonium inner salt charge enhancing additives that may be selected for incorporation into the toner compositions of the present invention include those of the following formulas:

II. BETAINES

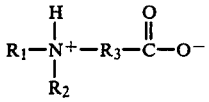

III. PHOSPHONIUMS

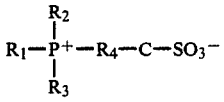

wherein $R_1$, $R_2$, and $R_3$ are as defined hereinbefore, and $R_4$ is selected from the group consisting of alkyl and aryl substituents.

Examples of R alkyl substituents include those of from about 1 to about 25 carbon atoms such as methyl, ethyl, propyl, isopropyl, butyl, isobutyl, pentyl, hexyl, octyl, nonyl, decyl, cetyl, stearyl, pentadecyl, and other similar substituents. Aromatic substituents usually contain from about 6 to about 24 carbon atoms such as phenyl, anthracyl and naphthyl with phenyl being preferred. The alkyl and aromatic groups can be substituted by various known moieties provided the objectives of the present invention are achievable. These moieties include alkyl, halogen, nitro, alkoxy, and the like.

Specific examples of inner salt charge enhancing additives selected for incorporation into the toner and developer compositions of the present invention include:

IV. N-STEARYL-N-DIMETHYL-N-(3-SULFOPROPYL)AMMONIUM SULFONATE*

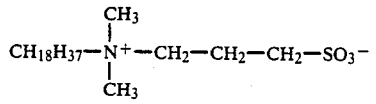

*Commercially available from Howard Hall International, Connecticut.

V. 5-DIMETHYLAMINE-1-NAPHTHALENE SULFONIC ACID (DANS)-commercially available from Aldridge Chemical Company, Inc., and VI. 1,4-PIPERAZINE BIS(ETHANE SULFONIC ACID) (PIPES)-commercially available from Aldridge Chemical Company, Inc.

Other charge enhancing additives not specifically disclosed herein can be selected for the toner and developer compositions of the present invention providing that the positive and negative charge centers are covalently bonded thereto, and moreover the objectives of the present invention are achievable. In addition, second negative charge enhancing additives may be useful in the present invention such as ortho-halophenol carboxylic acids, reference U.S. Pat. No. 4,411,974, the disclosure of which is totally incorporated herein by reference.

With further regard to the inner salt charge enhancing additives of the present invention, as indicated herein there can be incorporated into the developer compositions mixtures of the aforementioned additives with other second charge enhancing additives inclusive of those illustrated hereinbefore. The mixture of additives are selected in amounts that will enable the objectives of the present invention to be achievable, and further these amounts are dependent on a number of factors inclusive of the particular charge enhancing additives selected. However, generally there is selected for the mixture from about 90 percent by weight to about 10 percent by weight of the inner salt charge enhancing additive illustrated herein, and from about 10 percent by weight to about 90 percent by weight of second charge enhancing additives such as, for example, distearyl dimethyl ammonium methyl sulfate.

Various suitable toner resins can be selected inclusive of polyamides, epoxies, diolefins, polyurethane, vinyl resins and polymeric esterification products of a dicarboxylic acid and a diol comprising a diphenol. Any suitable vinyl resin may be selected for the toner resins of the present application including homopolymers or copolymers of two or more vinyl monomers. Typical vinyl monomeric units are: styrene, p-chlorostyrene vinyl naphthalene unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters like esters of monocarboxylic acids including methyl acrylate, ethyle acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers such as vinyl methyl ether, vinyl isobutyl ether and vinyl ethyl ether; vinyl ketones inclusive of vinyl methyl ketone, vinyl hexyl ketone, and methyl isopropenyl ketone; vinylidene halides such as vinylidene chloride and vinylidene chlorofluoride; N-vinyl indole and N-vinyl pyrrolidene; styrene butadiene copolymers, inclusive of suspension polymerized styrene butadienes and emulsion polymerized styrene butadienes, reference U.S. Pat. Nos. 4,558,118 and 4,469,770, the disclosures or each of these patents being totally incorporated herein by reference; and mixtures thereof.

As one preferred toner resin there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bisphenol A and propylene oxide, followed by the reaction of the resulting product with fumaric acid, and branched polyester resins resulting from the reaction of dimethylterephthalate, 1,3-butanediol, 1,2-propanediol, and pentaerythritol.

The resin particles are present in a sufficient, but effective amount; thus, when 5 percent by weight of the inner salt charge enhancing additive compound and 10 percent by weight of pigment or colorant such as carbon black is contained therein, about 85 percent by weight of resin material is selected. Generally, from about 0.1 weight percent to about 20 weight percent, and preferably from about 0.5 weight percent to about 5 weight percent of the inner salt, or a mixture of the inner salt and a second charge additive is selected for mixing with the toner particles, however, the charge enhancing additive of the present invention can be used in various other amounts providing the objectives of the present invention are accomplished. The inner salt charge enhancing additive of the present invention can be blended into the toner composition, or coated on the pigment particles such as carbon black, which are used as the colorants in the developer composition. When used as a coating, the charge enhancing additive of the present invention is present in an amount of from about 0.1 weight percent to about 5 weight percent, and preferably in an amount of from about 0.3 weight percent to about 1 weight percent. Generally, however, the inner salt charge enhancing additive of the present invention can be incorporated into the toner composition in various effective amounts providing the objectives thereto are achievable. Thus, for example, from about 1 percent to about 25 percent by weight of the charge enhancing additive may be selected.

Numerous well known suitable pigments or dyes can be selected as the colorant for the toner particles including, for example, carbon black, nigrosine dye, aniline blue, magnetites, and mixtures thereof. The pigment such as carbon black should be present in a sufficient amount to render the toner composition highly colored in order that it will cause the formation of a clearly visible image on a suitable recording member. Generally, the pigment particles are present in amounts of from about 2 percent by weight to about 20 percent by weight, based on the total weight of the toner composition; however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as Mapico Black, these pigments are present in the toner composition in an amount of from about 10 percent by weight to about 70 percent by weight, and preferably in an amount of from about 15 percent by weight to about 50 percent by weight.

Also encompassed within the scope of the present invention are colored toner compositions with the inner salt charge enhancing additives illustrated herein, wherein the colorants are, for example, magenta, cyan, yellow, red, blue, green, brown and mixtures thereof. More specifically, with regard to the generation of color images utilizing a developer composition containing the charge enhancing additives of the present invention, or mixtures thereof as illustrated herein, illustrative examples of magenta materials that may be selected as pigments include, for example, 1,9-dimethyl-substituted quinacridone and anthraquinone dye identified in the Color Index as Cl 60710; Cl Dispersed Red 15, a diazo dye identified in the Color Index as Cl 26050; Cl Solvent Red 19; and the like. Illustrative examples of cyan materials that may be used as pigments include copper tetra-4(octadecyl sulfonamido)phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected include diarylide yellow 3,3-dichlorobenzidene acetoacetanilides, a monoazo pigment identified in the Color Index as Cl 12700; Cl Solvent Yellow 16, a nitrophenyl amine sulfonamide identified in the color Index as Foron Yellow SE/GLN; Cl Dispersed Yellow 33, 2,5-dimethoxy-4-sulfonanilide phenylazo-4'-chloro2,5-dimethoxy acetoacetanilide; Permanent Yellow FGL; and the like. These pigments are generally present in the toner composition in an amount of from about 2 weight percent to about 15 weight percent based on the weight of the toner resin particles.

Illustrative examples of carrier particles that can be selected for mixing with the toner particles of the present invention include those components that are capable of triboelectrically obtaining a charge of opposite polarity to that of the toner particles. Accordingly, the carrier particles of the present invention can be selected to be of a negative polarity, thus the toner particles which are positively charged will adhere to and surround the carrier particles. Illustrative examples of carrier particles include methyl methacrylate, glass, steel, nickel, iron ferrites, silicon dioxide, and the like. Additionally, there can be selected as carrier particles nickel berry carriers as illustrated in U.S. Pat. No. 3,847,604, the disclosure of which is totally incorporated herein by reference, which carriers are comprised of nodular carrier beads of nickel characterized by surfaces of reoccurring recesses and protrusions thereby providing particles with a relatively large external area. Examples of useful carrier particles for admixing with the toner compositions of the present invention to enable the formulation of developers include those as described in U.S. Pat. Nos. 3,839,029; 3,849,182; 3,914,181; and 3,929,657, the disclosures of which are totally incorporated herein by reference.

The selected carrier particles can be used with or without a coating, the coating generally containing fluoropolymers, such as polyvinylidenefluoride resins, terpolymers of styrene, methylmethacrylate, and a vinyl silane, such as triethoxy silane, tetrafluoroethylenes, fluorinated copolymers such as FPC461, and the like. Specific examples of carrier coatings that may be selected are illustrated in U.S. Pat. Nos. 3,467,634; 3,526,533; 3,849,182; and 3,923,503, the disclosures of which are totally incorporated herein by reference.

Further, the diameter of the carrier particles can vary; generally, however, the diameter of these particles is from about 50 microns to about 1,000 microns thus allowing them to possess sufficient density and inertia to avoid adherence to the electrostatic images during the development process. The carrier particles can be mixed with the toner particles in various suitable combinations, however, best results are obtained when about 1 part per toner to about 10 parts to about 200 parts by weight of carrier are mixed.

Moreover, there can be incorporated into the toner and developer compositions of the present invention various additives such as colloidal silica and metal salts of fatty acids inclusive of Aerosil R972 and zinc stearates. These additives are usually present in an amount of from about 0.1 percent to about 7 percent, and are added to the toner compositions subsequent to the formulation thereof. Examples of the aforementioned additives are described in U.S. Pat. Nos. 3,590,000; 3,655,374; 3,720,617; and 3,923,503, the disclosures of each of these patents being totally incorporated herein by reference.

The toner composition of the present invention can be prepared by a number of known methods including melt blending the toner resin particles, pigment particles or colorants, and the inner salt charge enhancing additive of the present invention followed by mechanical attrition. Other methods include those well known in the art such as spray drying, melt dispersion, dispersion polymerization, extrusion processing, and suspension polymerization. In one dispersion method, a solvent dispersion of the resin particles, the pigment particles, and the inner salt charge enhancing additive is spray dried under controlled conditions to result in the desired product. Toner compositions prepared in this manner result in a positively charged toner composition in relation to the carrier materials selected, and these materials exhibit the improved properties as mentioned hereinbefore.

Additionally, the toner and developer compositions of the present invention with the inner salt additives, or mixtures of these additives with other charge control agents may be selected for use in developing images in electrostatographic imaging systems, containing therein conventional photoreceptors providing that they are capable of being charged negatively. This usually occurs with organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers include trigonal selenium, metal phthalocyanines, metal free phthaloxyanines, and vanadyl phthalocyanines, which examples of charge transport layers include the diamines as disclosed in the '990 patent. Other photoresponsive devices useful in the present invention include polyvinylcarbazole 4-dimethylaminobenzylidene, benzhydrazide; 2-benzylidene-amino-carbazole; 4-dimethamino-benzylidene; (2-nitrobenzylidene)-p-bromoaniline; 2,4-diphenylquinazoline; 1,2,4-triazine; 1,5-diphenyl-3-methyl pyrazoline 2-(4'-dimethyl-amino phenyl)benzoazole; 3-amino-carbazole; polyvinyl carbazole-trinitrofluorenone charge transfer complex; and mixtures thereof.

With further respect to the toners and developers of the present invention, the toners generally contain thereon for extended time periods exceeding, for example greater than 10,000 imaging cycles, a triboelectric charge of from about 5 to about 50 microcoulombs per gram; and preferably from about 10 to about 30 microcoulombs per gram. The aforementioned triboelectric charge can be less or greater than the values given providing the objectives of the present invention are achievable, and moreover as is known in the prior art the triboelectric charge can be controlled by selecting the appropriate carrier coating for the component present in the developer composition. In addition, the admixing charging characteristics of these toners are exceptional, that is uncharged toner added to the charged toner compositions of the present invention will acquire a positive charge in a period of from about 5 seconds to about 1 minute permitting images with low background and high resolution to be immediately obtained with the first imaging cycle in contrast to some prior art toner compositions, wherein the uncharged toner does not acquire the appropriate triboelectric charge for a period of at least 5 minutes thereby adversely effecting the image quality of the images generated. Additionally, the toner compositions of the present invention are Viton compatible, that is they do not substantially effect in any manner Viton fuser rolls. Other important characteristics associated with the toners and developers of the present invention include lower fusing temperatures, that is for example, from about 20° F. to about 40° F. lower than achievable for toners and developers having incorporated therein some of the charge enhancing additives of the prior art including the quaternary ammonium salts, and particularly additives such as distearyl dimethyl ammonium methyl sulfate.

The following examples are being supplied to further define various species of the present invention, it being noted that these examples are intended to illustrate and not limit the scope of the present invention. Parts and percentages are by weight unless otherwise indicated.

EXAMPLE I

There was prepared a prior art toner composition comprised of 79.5 percent by weight of a styrene butadiene copolymer (87/13), 16 percent by weight of the magnetite Mapico Black, 4 percent by weight of Regal® 330 carbon black, and 0.5 percent by weight of the charge enhancing additive distearyl dimethyl ammonium methyl sulfate. Thereafter, a developer composition was prepared by mixing 3 percent by weight of the above prepared toner with 97 percent by weight of carrier particles consisting of a steel core with a coating thereover of 0.3 percent Kynar and 0.4 percent polymethylmethacrylate. The toner composition had a trioelectric charge of 16 microcoulombs per gram as determined in a Faraday Cage apparatus, and further this toner possessed an admix charging time of greater than one minute at which time the test was terminated as determined in a charge spectrograph.

Thereafter, two developer compositions B and C were prepared by repeating the above procedure with the exception that there was selected for composition B one perecent by weight of the charge enhancing additive and 79 percent by weight of the styrene butadiene copolymer; and for the C composition 1.5 percent by weight of the charge enhanging additive, and 78.5 percent by weight of the styrene butadiene copolymer. Toner composition B had a triboelectric charge of 27 microcoulombs per gram and an admix time of one minute; while toner compositions C had a triboelectric charge of 36 microcoulombs per gram and an admix time of about 30 seconds.

A developer composition of the present invention was prepared by repeating the above procedure with the exception that the toner composition contained in addition to 78.5 percent by weight of the styrene butadiene copolymer, 16 percent by weight of the magnetite Mapico Black, 4 percent by weight of Regal® 330 carbon black, and 0.5 percent by weight of the distearyl dimethyl ammonium methyl sulfate, 1 percent by weight of the inner salt charge enhancing additive of the present invention identified as STEDSPAS, which is N-stearyl-N-dimethyl-N-(3-sulopropyl)ammonium sulfate; and there resulted in the toner composition a triboelectric charge of 18 microcoulombs per gram and the admixing charging time was less than 15 seconds.

EXAMPLE II

There were prepared three developer compositions by repeating the procedure of Example I with the primary exception that there was selected as the carrier particles a steel core containing a coating thereover at a 1.25 percent coating weight of a copolymer of vinyl chloride and trifluorochloroethylene available as FPC461. The coating also contained 7.5 percent of Regal® 330 carbon black, reference copending application U.S. Ser. No. 751,922 entitled Developer Compositions With Specific Carrier Particles, the disclosure of which is totally incorporated herein by reference. The first toner was comprised of 80 percent by weight of a styrene butadiene resin, 16 percent by weight of the magnetite Mapico Black, and 4 percent by weight of Regal® 330 carbon black, which toner had a triboelectric charge thereon 23 microcoulombs per gram and an admix time of greater than one minute. The second toner composition contained 79 percent by weight of styrene butadiene copolymer, 16 percent by weight of Mapico Black, 4 percent by weight of Regal® 330 carbon black, and one percent by weight of the charge enhancing additive distearyl dimethyl ammonium methyl sulfate. The third toner composition contained 79 percent by weight of a styrene butadiene copolymer resin, 16 percent by weight of the magnetite Mapico Black, 4 percent by weight of Regal® 330 carbon black, and one precent by weight of the charge enhancing additive inner salt N-stearyl-N-dimethyl-N-(3-sulfopropyl)ammonium sulfonate. The second toner composition had a triboelectric charge of 47 microcoulombs per gram and an admix time of approximately one minute; while the third toner composition had a triboelectric charge thereon of 30 microcoulombs per gram and an admix time of less than 15 seconds. Accordingly, there is achievable with the developer composition of the present invention containing the inner salt charge enhancing additive indicate, that is STEDSPAS, a more rapid admix which simultaneously possesses a desirable triboelectric charging value. In addition, the minimum fusing temperatures for accomplishing permanent attachment of the image to paper as determined by the crease area test to achieve 50 crease area units was 313° F. for the above-identified toner composition containing no charge enhancing additive; 330° F. for the above-identified toner composition containing 1 percent by weight of the charge enhancing additive STEDSPAS; and was 353° F. or 40° F. higher for the above toner composition with 1 percent by weight of the prior art charge enhancing additive distearyl dimethyl ammonium methyl sulfate. In these tests there was selected a Viton fuser roll.

EXAMPLE III

There were prepared two toner compositions by repeating the process of Example II enabling toner and developer compositions wherein one toner was comprised of 79 percent by weight of a styrene butadiene copolymer resin, 16 percent by weight of the magnetite, 4 percent by weight of Regal® 330 carbon black, and one precent by weight of the charge enchancing additive inner salt 5-dimethyl amino-1-naphthalene sulfonic acid, which toner had a triboelectric charge thereon of 19 microcoulombs per gram and an admix time of about one minute. The second toner contained 79 percent by weight of a styrene butadiene copolymer resin, 16 percent by weight of the magnetite, 4 percent by weight of Regal® 330 carbon black, and one percent by weight of 1,4-piperazine bis(ethane sulfonic acid) inner salt charge enhancing additive. This toner had a triboelectric charge thereon of 29 microcoulombs per gram and an admix time of one minute. Toner admix times of less than 5 minutes are generally desirable with respect to the utilization of the resulting toner in electrostatographic imaging systems.

The admix time for each of the above prepared compositions was accomplished on a toner charge spectrograph which is an instrument that dispenses toner particles in proportion to the charge to diameter ratio, and with the aid of automated microscopy can generate charge distribution histograms for selected toner size classes.

The developer composition prepared in accordance with Example III, and containing the charge enhancing additives of the present invention can be selected for developing images in a xerographic imaging device containing a layered photoreceptor comprised of a Mylar substrate overcoated with a photogenerating layer of trigonal selenium (90 percent) dispersed in a polyvinyl carbazole binder, and as top layer in contact with the photogenerating layer the charge transport molecules N,N-diphenyl-N,N'-bis(3-methylphenyl)1,1'-biphenyl-4,4'-diamine (55 percent) dispersed in a polycarbonate resin commercially available as Makrolon, which device was prepared in accordance with the disclosure of U.S. Pat. No. 4,265,990, and there can be obtained high quality images with no background deposits. The device selected may also include a Viton fuser roll, and it is believed that visual observation after 50,000 imaging cycles will indicate no damage occurred to the Viton fuser roll, that is the Viton will not turn black, will not crack, and the surface will not harden; but rather remained smooth and soft although very slight darkened.

When cetyl pyridinium chloride in the same amount was substituted for the inner salt additive in the above developer composition, and images were developed with this composition, excellent quality images were initially obtained, however, the Viton fuser roll blackened and appeared to develop surface cracks; and the Viton surface hardened after about 5,000 imaging cycles. Image quality deteriorated rapidly after about 5,000 imaging cycles, an image resolution was very poor due to the reaction of the cetyl pyridinium chloride with the Viton fuser roll.

Other modifications of the present invention may occur to those skilled in the art based upon a reading of the present disclosure and these modifications are intended to be included within the scope of the present invention.

What is claimed is:

1. A toner composition comprised of resin particles, pigment particles, and as a charge enhancing additive inner salts selected from the group consisting of those components with the following formulas:

I. SULFOPROPYL DERIVATIVES

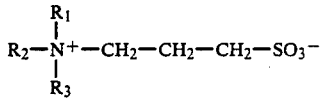

II. BETAINES

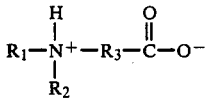

wherein $R_1$, $R_2$, and $R_3$ are independently selected from the group consisting of alkyl, aryl, substituted alkyl, and substituted aryl.

2. A toner composition in accordance with claim 1 wherein the alkyl substituents contain from 1 to about 25 carbon atoms.

3. A toner composition in accordance with claim 1 wherein the alkyl substituent is methyl.

4. A toner composition in accordance with claim 1 wherein the aryl substituent contains from about 6 to about 24 carbon atoms.

5. A toner composition in accordance with claim 1 wherein the aryl substituent is phenyl.

6. A toner composition in accordance with claim 1 wherein the sulfopropyl derivative is N-stearyl-N-dimethyl-N-(3-sulfopropyl)ammonium sulfonate.

7. A toner composition in accordance with claim 1 wherein the inner salt is 5-dimethyl amino-1-naphthalene sulfonic acid.

8. A toner composition in accordance with claim 1 wherein the inner salt is 1,4-piperazine bis(ethane sulfonic acid).

9. A toner composition in accordance with claim 1 wherein the resin is styrene alkyl methacrylate or a styrene butadiene polymer.

10. A toner composition in accordance with claim 9 wherein the styrene alkyl methacrylate is styrene/n-butyl methacrylate.

11. A toner composition in accordance with claim 9 wherein the butadiene polymer contains from about 75 percent by weight to about 95 percent by weight of styrene.

12. A toner composition in accordance with claim 1 wherein the pigment particles are carbon black or magnetite.

13. A toner composition in accordance with claim 1 wherein the inner salts are present in an amount of from about 0.1 percent by weight to about 20 percent by weight.

14. A developer composition comprised of the toner composition of claim 1 and carrier particles.

15. A developer composition in accordance with claim 14 wherein the carrier particles consist of steel core coating with a fluoropolymer.

16. A developer composition with claim 14 wherein the fluoropolymer is a polytrifluoroethylene-co-vinylchloride copolymer.

17. A developer composition in accordance with claim 14 wherein the inner salts selected from the group consisting of

I. SULFOPROPYL DERIVATIVES

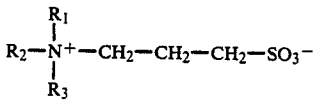

and

II. BETAINES

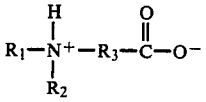

wherein $R_1$, $R_2$, and $R_3$ are independently selected from the group consisting of alkyl, aryl, substituted alkyl, and substituted aryl.

18. A developer composition in accordance with claim 17 wherein the sulfopropyl derivative is N-stearyl-N-dimethyl-N-(3-sulfopropyl)ammonium sulfonate.

19. A developer composition in accordance with claim 17 wherein the sulfopropyl derivative is 5-dimethyl amino-1-naphthalene sulfonic acid.

20. A developer composition in accordance with claim 17 wherein the sulfopropyl derivative is 1,4-piperazine bis(ethane sulfonic acid).

21. A developer composition comprised of the toner composition of claim 9 and carrier particles.

22. A developer composition in accordance with claim 21 wherein the carrier particles consist of a steel core coated with a fluoropolymer.

23. A developer composition in accordance with claim 22 wherein the fluoropolymer is a polytrifluorochloroethylene-co-vinylchloride copolymer.

24. A developer composition in accordance with claim 14 wherein the resin is a styrene alkyl methacrylate or a styrene butadiene polymer.

25. A developer composition in accordance with claim 24 wherein the styrene alkyl methacrylate is styrene/n-butyl methacrylate.

26. A developer composition in accordance with claim 24 wherein the butadiene polymer contains from about 75 percent by weight to about 95 percent by weight of styrene.

27. A developer composition in accordance with claim 14 wherein the pigment particles are carbon black or magnetite.

28. A developer composition in accordance with claim 14 wherein the inner salts are present in an amount of from about 0.1 percent by weight to about 20 percent by weight.

29. A developer composition in accordance with claim 21 wherein the resin is a styrene alkyl methacrylate or a styrene butadiene polymer.

30. A developer composition in accordance with claim 29 wherein the styrene alkyl methacrylate is styrene/n-butyl methacrylate.

31. A developer composition in accordance with claim 29 wherein the butadiene polymer contains from about 75 percent by weight to about 95 percent by weight of styrene.

32. A toner composition in accordance with claim 1 further including therein second charge enhancing additives.

33. A developer composition in accordance with claim 14 further including therein second charge enhancing additives.

34. A developer composition in accordance with claim 32 wherein the second charge enhancing additives are quaternary ammonium salts.

35. A developer composition in accordance with claim 33 wherein the second charge enhancing additives are quaternary ammonium salts.

36. A developer composition in accordance with claim 32 wherein the second charge enhancing additives are selected from the group consisting of distearyl dimethyl ammonium methyl sulfate, cetyl pyridinium halides, and organic sulfate and sulfonate compositions.

37. A developer composition in accordance with claim 33 wherein the second charge enhancing additives are selected from the group consisting of distearyl dimethyl ammonium methyl sulfate, cetyl pyridinium halides, and organic sulfate and sulfonate compositions.

38. A developer composition in accordance with claim 36 wherein the charge enhancing additive is stearyl phenethyl dimethyl ammonium tosylate.

39. A developer composition in accordance with claim 37 wherein the charge enhancing additive is stearyl phenethyl dimethyl ammonium tosylate.

40. A developer composition in accordance with claim 32 wherein the second charge enhancing additives are present in an amount of from about 10 percent by weight to about 90 percent by weight, and the inner salt charge enhancing additives are present in an amount of from about 90 percent by weight to about 10 percent by weight.

41. A developer composition in accordance with claim 33 wherein the second charge enhancing additives are present in an amount of from about 10 percent by weight to about 90 percent by weight, and the inner salt charge enhancing additives are present in an amount of from about 90 percent by weight to about 10 percent by weight.

42. A toner composition in accordance with claim 1 wherein the pigment particles are selected from the group consisting of cyan, magenta, yellow, red, blue, green, and mixtures thereof.

43. A toner composition in accordance with claim 1 wherein the pigment particles are comprised of a mixture of carbon black and magnetites.

44. A method for developing latent images which comprises formin an electrostatic latent image on a photoconductive imaging member, contacting the image with the toner composition of claim 1, followed by transferring the image to a suitable substrate, and optionally permanently affixing the image thereto.

45. A method of imaging in accordance with claim 44 wherein there is selected as the charge enhancing additives a mixture of the inner salts of claim 1 and second charge enhancing additives.

46. A method of imaging in accordance with claim 45 wherein the second charge enhancing additive is quaternary ammonium salt.

47. A method of imaging in accordance with claim 45 wherein the second charge enhancing additive is selected from the group consisting of distearyl dimethyl ammonium methyl sulfate, cetyl pyridinium halides, and organic sulfate and sulfonate compositions.

48. A method of imaging in accordance with claim 44 wherein there are selected as the pigment particles carbon black, magnetites, or mixtures thereof.

49. A method of imaging in accordance with claim 44 wherein there are selected as the pigment particles components selected from the group consisting of cyan, magenta, yellow, red, blue, green, and mixtures thereof.

50. A method of imaging in accordance with claim 45 wherein there are selected as the pigment particles a mixture of carbon black and magnetite.

51. A method of imaging in accordance with claim 44 wherein there is selected an electrostatographic imaging device containing therein a Viton fuser roll.

52. A toner composition consisting essentially of resin particles, pigment particles, and as a charge enhancing additive inner salts selected from the group consisting of N-stearyl-N-dimethyl-N-(3-sulfopropyl)ammonium sulfonate, 5-dimethyl amine-1-naphthalene sulfonic acid, and 1,4-piperazine bis(ethane sulfonic acid).

53. A toner composition in accordance with claim 52 wherein the inner salt charge enhancing additive is present in an amount of from about 0.5 percent by weight to about 5 percent by weight.

54. A toner composition in accordance with claim 52 wherein the resin particles are comprised of a styrene butadiene polymer.

55. A toner composition in accordance with claim 52 wherein the pigment particles are comprised of carbon black particles, magnetite, or mixtures thereof.

56. A toner composition in accordance with claim 52 wherein the toner composition contains therein a second charge enhancing additive.

57. A toner composition in accordance with claim 56 wherein the second charge enhancing additive is a quaternary ammonium salt.

58. A toner composition in accordance with claim 56 wherein the second charge enhancing additive is selected from the group consisting of distearyl dimethyl ammonium methyl sulfate, cetyl pyridinium halides, and organic sulfate and organic sulfonate compositions.

59. A toner composition in accordance with claim 56 wherein the second charge enhancing additive is distearyl dimethyl ammonium methyl sulfate present in an amount of from about 0.5 percent by weight to about 5 percent by weight.

60. A developer composition comprised of the toner composition of claim 53, and carrier particles.

61. A developer composition in accordance with claim 60 wherein the carrier particles consist of a core with a coating thereover.

62. A developer composition in accordance with claim 61 wherein the core is comprised of steel.

63. A developer composition in accordance with claim 61 wherein the coating is a fluoropolymer.

64. A developer compsition in accordance with claim 63 wherein the fluoropolymer is polytrifluorochlorocovinylchloride copolymer.

65. A developer composition in accordance with claim 62 wherein the carrier coating includes therein conductive particles.

66. A developer composition in accordance with claim 65 wherein the conductive particles are carbon black.

* * * * *